US008215457B2

(12) United States Patent
Karkela

(10) Patent No.: US 8,215,457 B2
(45) Date of Patent: Jul. 10, 2012

(54) MULTIFUNCTION CALL BUTTONS FOR AN ELEVATOR SYSTEM

(75) Inventor: Petri Karkela, Kausala (FI)

(73) Assignee: Otis Elevator Company, Farmington, CT (US)

( * ) Notice: Subject to any disclaimer, the term of this patent is extended or adjusted under 35 U.S.C. 154(b) by 480 days.

(21) Appl. No.: 12/522,780

(22) PCT Filed: Feb. 22, 2007

(86) PCT No.: PCT/EP2007/001554

§ 371 (c)(1), (2), (4) Date: Jul. 10, 2009

(87) PCT Pub. No.: WO2008/101518

PCT Pub. Date: Aug. 28, 2008

(65) Prior Publication Data

US 2010/0243380 A1 Sep. 30, 2010

(51) Int. Cl.
*B66B 13/02* (2006.01)

(52) U.S. Cl. ..... 187/315; 49/120

(58) Field of Classification Search ..... 187/247, 187/380–389, 391–396

See application file for complete search history.

(56) References Cited

U.S. PATENT DOCUMENTS

| | | | | |
|---|---|---|---|---|
| 4,682,673 | A * | 7/1987 | Umeda et al. | 187/384 |
| 5,821,479 | A * | 10/1998 | Kondo et al. | 187/395 |
| 5,969,306 | A * | 10/1999 | Velauthapillai et al. | 187/395 |
| 6,105,729 | A * | 8/2000 | Nakamori et al. | 187/391 |
| 6,502,668 | B1 * | 1/2003 | Chida et al. | 187/395 |
| 6,550,587 | B1 * | 4/2003 | Yuasa et al. | 187/394 |
| 7,040,458 | B2 * | 5/2006 | Forsythe et al. | 187/396 |
| 7,284,639 | B2 * | 10/2007 | Sasaki et al. | 187/395 |
| 7,469,772 | B2 * | 12/2008 | Takeuchi | 187/396 |
| 7,591,348 | B2 * | 9/2009 | Takeuchi | 187/391 |
| 7,854,300 | B2 * | 12/2010 | Nakashima | 187/396 |
| 2005/0224298 | A1 | 10/2005 | Felder et al. | |

FOREIGN PATENT DOCUMENTS

| | | | |
|---|---|---|---|
| FR | 2785597 | A1 | 5/2000 |
| GB | 2241090 | A * | 8/1991 |
| JP | 58151159 | | 10/1983 |
| JP | 61119564 | | 7/1986 |
| JP | 7010399 | A | 1/1995 |
| JP | 10226465 | A * | 8/1998 |
| JP | 2006143451 | A | 6/2006 |
| WO | 0102279 | A1 | 1/2001 |
| WO | 0125128 | A1 | 4/2001 |
| WO | 2004103879 | A1 | 12/2004 |

OTHER PUBLICATIONS

International Search Report and Written Opinion of the International Searching Authority for International application No. PCT/EP2007/001554 mailed Dec. 12, 2007.

* cited by examiner

*Primary Examiner* — Anthony Salata

(74) *Attorney, Agent, or Firm* — Carlson, Gaskey & Olds PC

(57) ABSTRACT

The object of the present invention is to provide a method and elevator system (1) that substantially reduces the installation costs when adding new elevator calls to an existing elevator system, or to reduce the amount of hardware required on installation of a new elevator system. A single push button (2) or a combination of push buttons (2) can be used by a user (4) to register a plurality of elevator calls by operating the push button (2), or combination of push buttons (2), in a predetermined manner to register an elevator call.

16 Claims, 5 Drawing Sheets

Figure 1
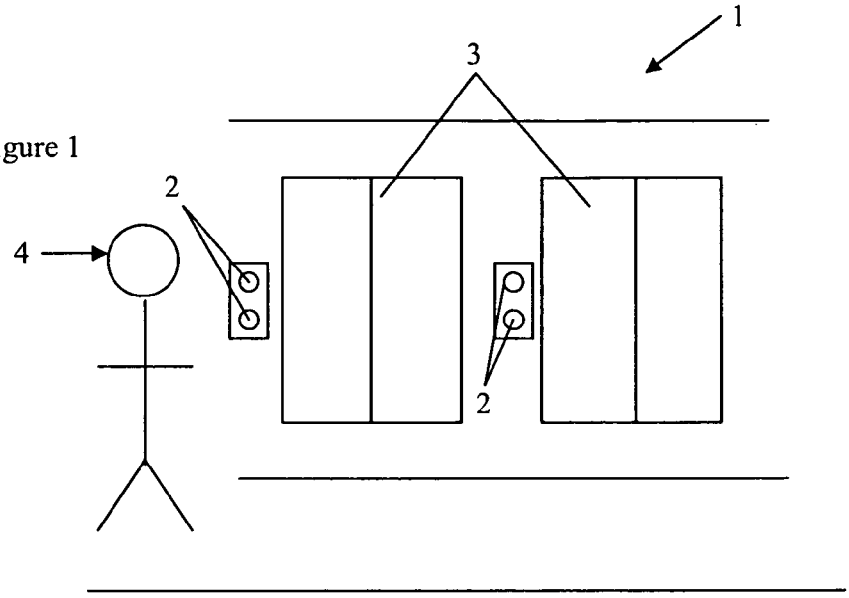
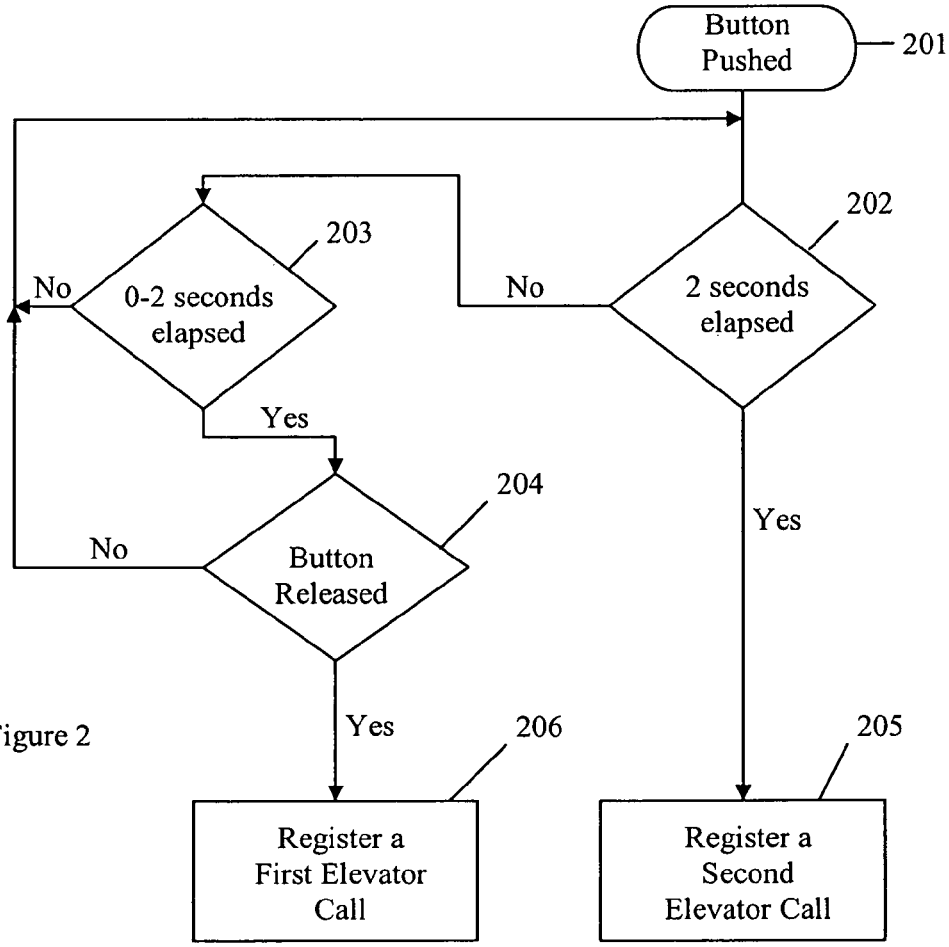
Figure 2

MULTIFUNCTION CALL BUTTONS FOR AN ELEVATOR SYSTEM

BACKGROUND OF THE INVENTION

1. Field of the Invention

The present invention relates to the registering of elevator calls in an elevator system and more particularly to the registering of a plurality of elevator calls.

2. Description of Prior Art

In existing elevator systems it is known to have input means, typically a push or touch button, to enable a user to register a call for an elevator. Typically a plurality of buttons is provided, each corresponding respectively to a different elevator call that can be registered by the user. For example, one button may be provided for a user to register a call for an elevator to travel to a destination floor above the floor on which the user registers the call (i.e. an up call), and a separate button for a user to register a call for an elevator to travel to a destination floor below the floor on which the user registers the elevator call (i.e. a down call).

Further types of elevator calls which can be registered in conventional elevator systems, e.g. a VIP call, a call for goods transportation, and so on, all require an associated separate button for a user to operate in order to register the associated elevator call.

Not only are such systems potentially cumbersome, but they also suffer from the potential problem that should a further type of elevator call need to be added after the elevator system has been installed, then a new button to enable the user to register that call has to be installed on each floor of the elevator system. This is both costly and time consuming.

SUMMARY OF THE INVENTION

The present invention seeks to provide an elevator call system which overcomes or at least mitigates the problems and drawbacks discussed above.

From a first aspect of the present invention there is provided a method of registering calls in an elevator system wherein the elevator system includes at least one input element, the method comprises the step of operating the input element in a first predetermined manner to register a first elevator call and operating the input element in a second predetermined manner to register a second elevator call.

The invention also extends to an elevator system comprising at least one input element, and further comprising means for sensing operation of the input element in a first predetermined manner to register a first elevator call and for sensing operation of the input element in a second predetermined manner to register a second elevator call.

The invention also extends to an elevator call system comprising means for sensing operation of a call input element in a first predetermined manner to register a first elevator call and for sensing operation of the input element in a second predetermined manner to register a second elevator call.

In accordance with the invention, therefore, a single input element can be used to register different calls, depending on its particular manner of operation.

In one embodiment the first predetermined manner involves operating the input element for less than a preset time period to register the first elevator call and the second predetermined manner involves operating the input element for greater than the preset time period to register the second elevator call.

In a further embodiment, the first predetermined manner may involve operating the input element a first preset number of times to register the first elevator call and the second predetermined manner involve operating the input element a second preset number of times to register the second elevator call More than one input element may be provided, and in accordance with a further aspect of the invention, there is provided a method of registering calls in an elevator system wherein the elevator system includes at least two input elements, the method comprises the step of operating the first input element and the second input element in a predetermined manner to register an elevator call.

The invention therefore also extends to an elevator system comprising at least two call input elements, and further comprising means for sensing operation of the first input element and the second input element in a predetermined manner to register an elevator call.

The invention also extends to an elevator call system comprising at least two call input elements, and further comprising means for sensing operation of the first input element and the second input element in a predetermined manner to register an elevator call.

In one embodiment, the predetermined manner may include operating the first input element and then operating the second input element within a preset time period of operating the first input element to register the elevator call.

The predetermined manner may include simultaneously operating the first input element and the second input element to register the elevator call.

In the above described methods of registering the elevator calls the preset time period is preferably in the range of 1 to 10 seconds, for example in the range of 1 to 3 seconds.

In a yet further embodiment, the first input element and the second input element may be operated a preset number of times in a predetermined sequence in order to register a specific call.

Although any multiple number of input elements can be provided, in a preferred embodiment, just two such elements are provided.

The input element can be any input element that enables the user to register the elevator call in the elevator system. The input element can therefore be a push button, a touch or proximity sensor, a slide button or rotational button, for example. Most preferably, however, the input element is a push or touch button.

In preferred embodiments, the input element or elements may provide an indication of the requested elevator call.

This is in itself a novel arrangement, so from a yet further aspect, there is provided an elevator system comprising one or input elements for registering elevator calls in the elevator system wherein at least one input element is configured such that it is able to provide a specific indication of more than one elevator call registered.

Preferably the specific indication is provided by one or both of different audio indications and different visual indications for each elevator call that can be registered.

For example, the different visual indications may include at least one of a constant illumination, an intermittent illumination, a dynamic illumination or differently coloured illuminations corresponding to different elevator calls. Thus in one example a clockwise rotating illumination of lights may indicate a first call and a counter clockwise rotating illumination of lights illustrate a second call. In other arrangements, different patters of lights may be illuminated to indicate the call.

Any combination of the above described visual indications can be used to indicate an elevator call, for example, different coloured, intermittent or blinking illumination of the input means can be used to indicate different elevator calls that can be registered.

For example, an operating button or indeed a surrounding bezel may be illuminated in the manner described above. For the purposes of this aspect of the invention, therefore, the term input element should also be understood to include any bezel surrounding the input element.

The audio indications may be ones of different tones, sounds or duration.

Accordingly, the present invention as hereinbefore described has several advantages over the existing elevator systems. In particular, the present invention allows for a plurality of different elevator calls to be associated or assigned to specific input elements or a combination of input elements where the elevator calls are registered by operating the input elements in a predetermined manner.

Therefore, should a new type of elevator call need to be added to the elevator system then existing input elements can simply be reconfigured to allow the user to register the new elevator call without the need to install new input elements on each floor of the elevator system.

Furthermore, it can be seen that on installation of a new elevator system the number of input elements required may also be substantially reduced as a plurality of different elevator calls can be associated or assigned to specific input elements or a combination of input elements so that separate input elements are not required for each and every type of elevator call that can be registered by the user in the elevator system.

The types of elevator calls which can be registered in accordance with the invention include not only up and down calls, but calls to place the elevator in any chosen mode, for example a maintenance mode, a rescue mode, a test mode, a VIP mode, a goods transportation mode and so on. The term call should therefore be understood in this context.

BRIEF DESCRIPTION OF THE DRAWINGS

Some preferred embodiments of the invention will now be explained, by way of example only, and with reference to the accompanying drawings, in which:

FIG. 1 shows an elevator system;

FIG. 2 shows a flow chart for a first embodiment of the invention;

DETAILED DESCRIPTION

Figure 3:
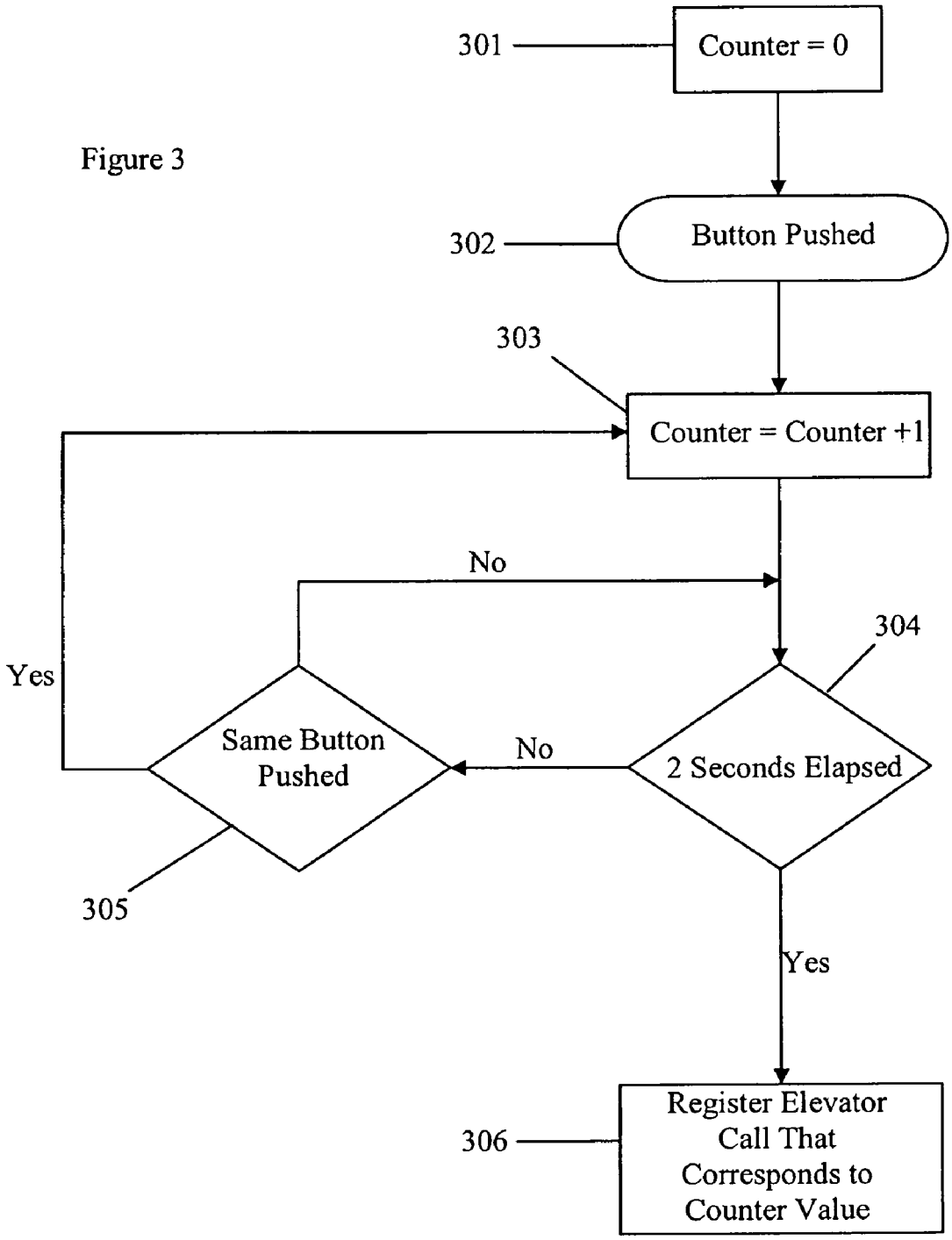
FIG. 3 shows a flowchart for a second embodiment of the invention.

With reference to FIG. 1, an elevator system 1 comprises an elevator 3 and at least one call button 2 which is pressed by a user 4 of the elevator system 1 in order to register an elevator call.

A call button or buttons is or are preferably located on each floor landing of a building housing the elevator system.

In the first and second described embodiments of the present invention the user 4 can register any one of a plurality of elevator calls using a single button 2.

In the first embodiment shown in FIG. 2, the control system determines in steps 202, 203 and 204 whether the user 4 has pressed or touched the button 2 for less than two seconds, If they have, then a first elevator call for example, a down call is registered at step 206.

However, if the user 4 presses or touches the button for more than two seconds before releasing the button then this is determined in step 202 and a second elevator call for example, an up call, is registered at step 205.

In the second embodiment of the present invention described in FIG. 3, the user 4 can register any one of a plurality of elevator calls using a single button 2. A first elevator call can be registered by pressing and releasing the button 2 once and further calls registered using the same button 2 by pushing the button a greater number of times. The operation of the button 2 may have to be carried out within a preset time period. For example, as shown in FIG. 3, a counter is initially set to zero in step 301. The user 4 pushes the button 2 in step 302 and the counter is incremented by 1 in step 303. If the same button 2 is pressed again during say a two second time period at step 305, then the counter is incremented by one, and so on until the two second time period has elapsed. The elevator call corresponding to the counter value is then registered in step 306.

Thus any number of different elevator calls can be registered by a user 4 pressing and releasing the same button 2 any number of times within the predetermined time period.

In other embodiments of the present invention different elevator calls can be registered operating a combination of buttons.

Figure 4:
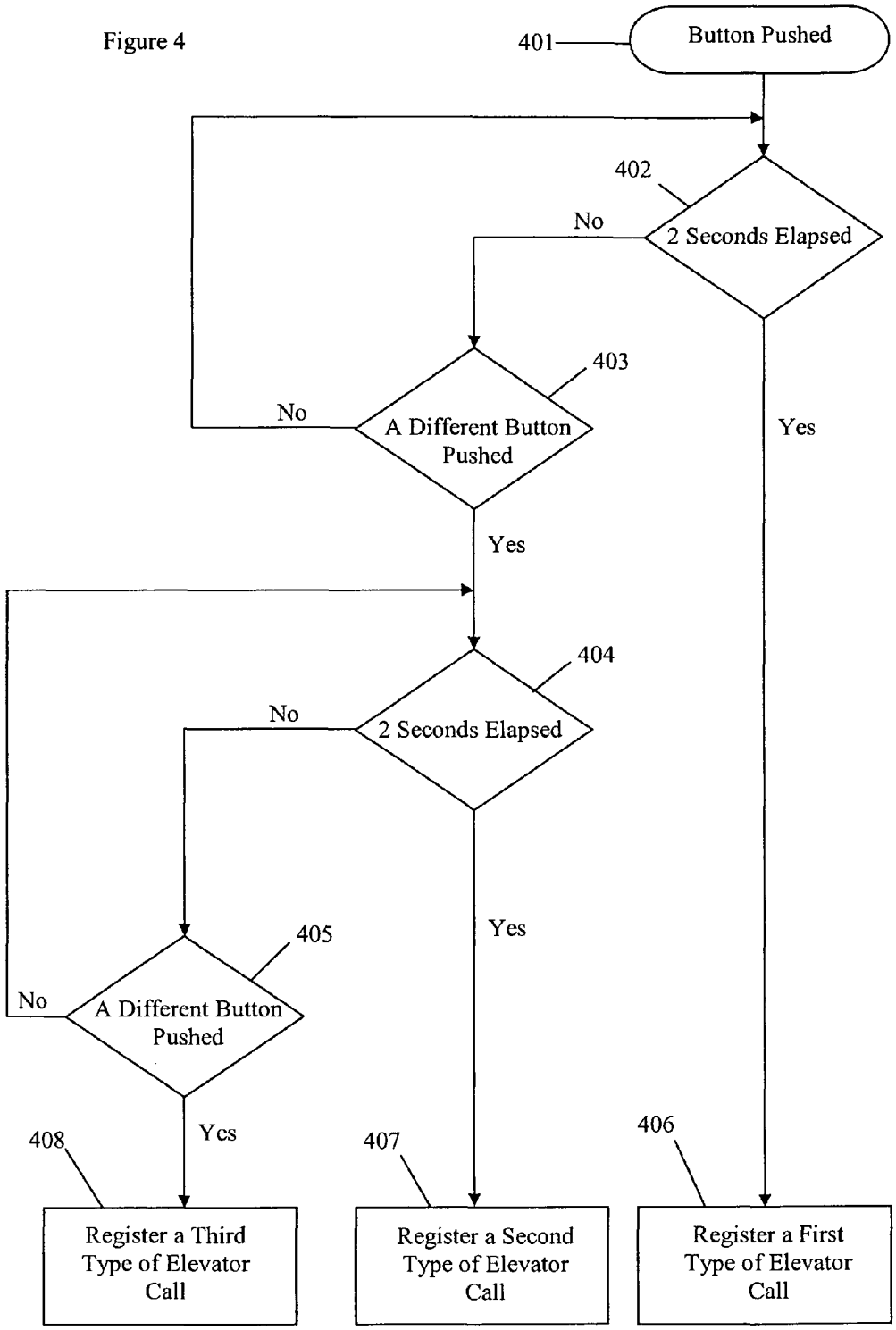
FIG. 4 shows a flowchart for a third embodiment of the invention.

For example, in the third embodiment as shown in FIG. 4, a user 4 can operate a first button 401 and then within a preset time period, in this embodiment two seconds, of operating the first button the user can operate a second different button 403 in order to register an elevator call 407.

In this embodiment it can be appreciated that any number of different buttons 2 can be operated within two seconds of the previously operated button 2 in order to register different types of elevator calls. For example as shown in FIG. 4, the user 4 could operate a first button at step 401, then operate a second different button at step 403 within two seconds of releasing the first button and then operate a third button (which could be a further different button or the same as the first or second button) at step 405 within two seconds of releasing the second button in order to register a further type of elevator call 408.

In a fourth embodiment, a user 4 can operate a first button 2 and then operate a second different button within a single two second time period in order to register an elevator call.

Figure 5:
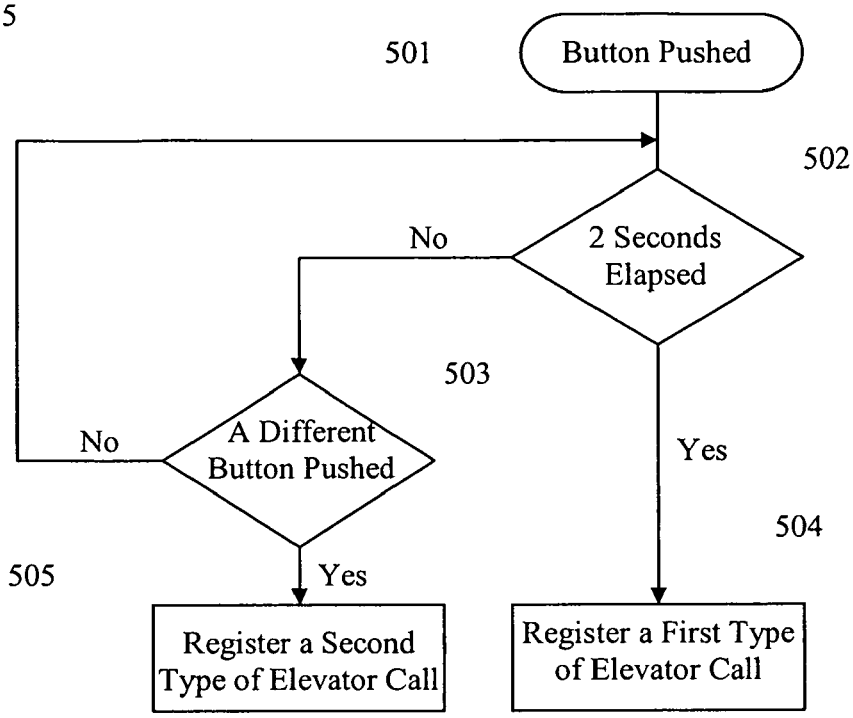
FIG. 5 shows a flowchart for a fourth embodiment of the invention.

In this embodiment it will be appreciated that any number of different buttons 2 can be operated within the single two second time period in order to register any one of a plurality of different elevator calls. For example as shown in FIG. 5, the user 4 could operate a first button at step 501 and then a second button at step 503 within the two second time period in order to register one type of elevator call 505.

In a fifth embodiment of the present invention an elevator call can be registered by operating a number of buttons simultaneously.

Figure 6:
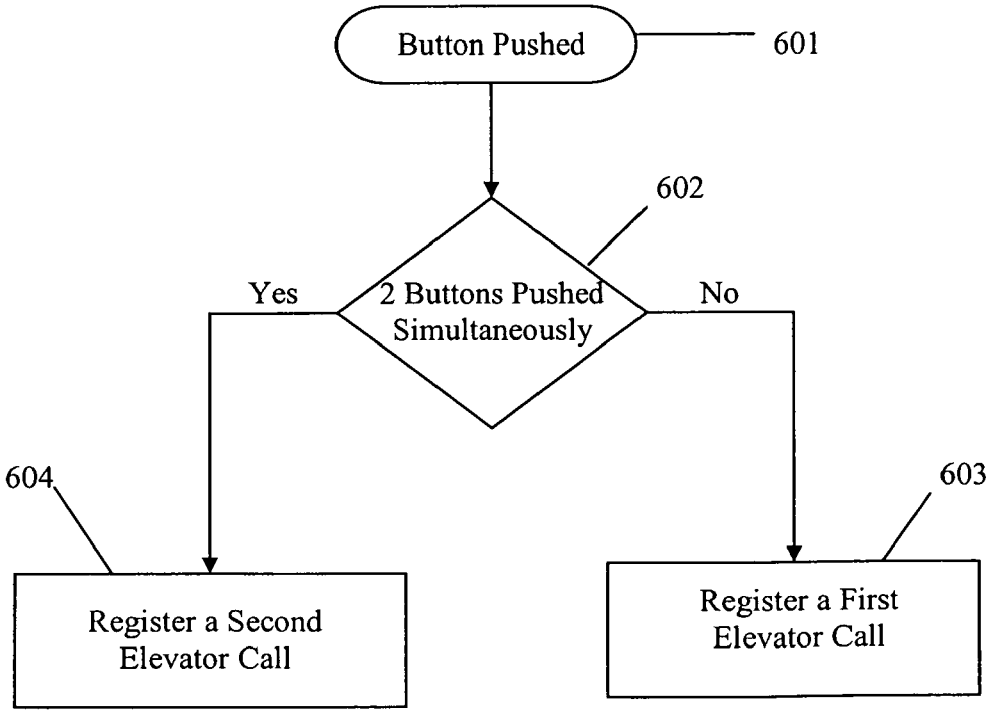
FIG. 6 shows a flowchart for a fifth embodiment of the invention.

For example as shown in FIG. 6, a user 4 can simultaneously operate a first button and a second button in step 601. If both are pressed simultaneously, as determined in step 602, one type elevator call will be registered in step 604. If they are not, a different call is registered in step 603.

In this embodiment it will be appreciated that any number of different buttons 2 can be operated simultaneously. For example, the user 4 could simultaneously operate a first button, a second button and a third button in order to register another type of elevator call. The number of buttons 2 that can be operated simultaneously by the user 4 is constrained by the practical limitations of the human hand.

It will also be appreciated in the preferred embodiments that any number of buttons 2 can be operated in any preset order.

In the above described embodiments the preset time periods are described as being set at two seconds. However, as will be appreciated by the skilled person, the preset time period could be set at, for example, one second, three seconds, four seconds, five seconds or any other desired period. It is most likely that the preset time period will be set to a time period in the range of 1 to 10 seconds and in particular in a range of 1 to 3 seconds.

It will also be understood that in the above described embodiments the preset time periods can start from the time at which a button is pressed or released.

The input elements operated by the user 4 to register an elevator call has been described in the foregoing embodiments as a push button 2 but the present invention is not limited thereto. The input element can be any suitable input element, for example, a slide button, a rotational button, a touch sensor or a touch button. In the embodiments where more than one input element is present each input element may be of the same or different shape, configuration or construction.

It will be appreciated that the above described methods of registering a plurality of elevator calls in the first to fifth embodiments can be implemented separately or in any combination thereof. For example, a user 4 of the elevator system could operate a single button 2 twice before a two second time period elapses (as described in the second embodiment) and then operate two different buttons simultaneously (as described in the fifth embodiment) in order to register a different type of elevator call.

Figure 7A:
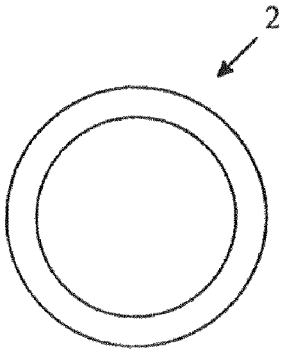
FIG. 7*a* shows an input element indicating no elevator call registered.
Figure 7B:
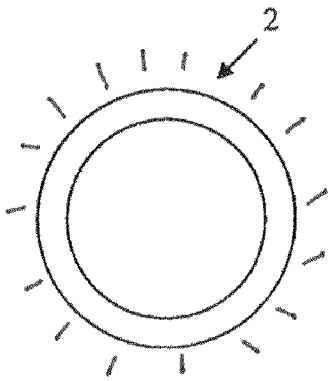
FIG. 7*b* shows an input element indicating a first type of call registered.

In the above described embodiments the input elements, e.g. the push buttons 2, can be used to indicate to the user 4 the type elevator call they have registered. Each elevator call that can be registered is indicated to the user 4 by, for example, illuminating the button operated in a manner that distinguishes between each type of elevator call. For example, the button 2 could be constantly illuminated for one elevator call registered as shown in FIG. 7*b*, or intermittently illuminated, i.e. blinking, for another type of elevator call.

Figure 7C:
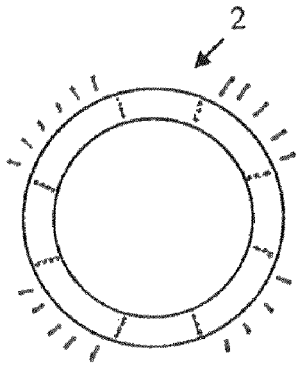
FIG. 7*c* shows an input element indicating a second type of call registered.

In an alternative arrangement, selected parts of the button could be selectively illuminated to show different calls. FIG. 7*c* shows spaced circumferential sections of the button being illuminated for this purpose.

Other methods of indicating to the user the elevator call registered could include, for example, illuminating the button operated with different colored lights for each type of elevator call that can be registered. Another possibility would be to have running patterns of lights, for example rotating lights. In a simple arrangement a clockwise rotating pattern might indicate an up call while a counter clockwise rotating pattern indicate a down call.

It will be appreciated that any combination of the aforementioned visual indications can be used to indicate to the user 4 the type elevator call registered. For example, different elevator calls can be indicated to the user 4 by illuminating the button 2 with different intermittent, e.g. blinking, colored lights.

It will also be understood that the illumination need not be of the button or input element itself but of an associated component e.g. a bezel surrounding the button per se.

It will also be appreciated that the method of indicating to the user 4 the type of elevator call registered is not limited to visual means but could be audio means. For example, the button 2 could indicate to the user 4 the elevator call registered by a number of beeps, or by using different audio tones for the different types of elevator calls registered.

It is also envisaged that the type of elevator call registered can be indicated to the user 4 via the input elements using a combination of both audio and visual indications.

As will be appreciated, the elevator control system can be implemented using software, hardware or any combination of software and hardware in order to determine the manner in which the input elements are operated and to determine the corresponding elevator call that is registered by the user 4.

From the above description it will be seen that the present invention can substantially reduce the installation and hardware costs associated with installing further input means, e.g. push buttons, to an existing elevator system when adding new types of elevator calls. Moreover, the present invention is advantageous when installing a new elevator system as the number of input means required to enable the user to register a plurality of different types of elevator calls can be substantially reduced.

A further advantage of the present invention is the use of the input elements as the means for indicating to the user the type of elevator call they have registered. Thus, further separate displays or other methods for indicating the type of elevator call registered may not be necessary with the present invention.

The present invention has been described with reference to a number of exemplary embodiments described above. However, the scope of the present invention is not limited to the described embodiments but is defined by the following claims.

The invention claimed is:

1. A method of registering calls in an elevator system wherein the elevator system includes at least one up or down hall call input element, the method comprising:

operating the input element in a first predetermined manner to register a first elevator call and operating the input elements in a second predetermined manner to register a second elevator call, wherein the first elevator call is one of an up call or a down call and the second elevator call is the other of the down call or the up call; and, operating the at least one up or down hall call input element to provide a first illumination pattern when the first elevator call is registered and to provide a second illumination pattern when the second elevator call is registered.

2. The method according to claim 1, wherein the first predetermined manner includes operating the input element for less than a preset time period to register the first elevator call and the second predetermined manner includes operating the input element for greater than the preset time period to register the second elevator call.

3. The method according to claim 2, wherein the preset time is set to be a time period in the range of 1 to 10 seconds.

4. The method according to claim 3, wherein the preset time period is set to be a time period in the range of 1 to 3 seconds.

5. The method according to claim 1, wherein the first predetermined manner includes operating the input element a first preset number of times to register the first elevator call and the second predetermined manner includes operating the input element a second preset number of times to register the second elevator call.

6. The method according to claim 1, comprising providing a different audio indication for the first and second elevator calls, respectively.

7. The method according to claim 1, wherein the illumination patterns include at least one of a constant illumination, an intermittent or blinking illumination, a dynamic illumination, or different colored illumination.

8. The method according to claim 6, wherein the different audio indications include at least different tones or different periods of time of the audio indication.

9. The method according to claim 1, wherein the input element includes a surrounding bezel that provides the illumination patterns, respectively.

10. An elevator system comprising:

at least one tip or down hall call input element; and a sensor that detects operation of the input element in a first predetermined manner to register a first elevator call and detects operation of the input element in a second predetermined manner to register a second elevator call, wherein the first elevator call is one of an up call or a down call and the second elevator call is the other of the down call or the up call; and, operating the at least one up or down hall call input element to provide a first illumination pattern when the first elevator call is registered and to provide a second illumination pattern when the second elevator call is registered.

11. The elevator system according to claim 10, wherein the first predetermined manner comprises operation of the input element for less than a preset time period to register the first elevator call and the second predetermined manner comprises operation of the input element for greater than the preset time period to register the second elevator call.

12. The elevator system according to claim 10, wherein the first predetermined manner comprises operation of the input element a first preset number of times to register the first elevator call and the second predetermined manner comprises operation of the input element a second preset number of times to register the second elevator call.

13. An elevator system comprising at least one up or down hall call input element for registering elevator calls in the elevator system wherein the input element provides different illumination patterns as an indication of a registered up or down elevator call, respectively.

14. The elevator system according to claim 13, wherein the different illumination patterns include at least one of a constant illumination, an intermittent or blinking illumination, a dynamic illumination, or different colored illuminations.

15. The elevator system according to claim 13, wherein the input element is configured to provide a different audio indication for the first and second calls, respectively, the audio indication comprising at least one of different tones or different periods of time of the audio indication.

16. The elevator system according to claim 13, wherein the input element includes a surrounding bezel that provides the illumination patterns, respectively.

* * * * *